United States Patent [19]

Joyce

[11] 4,366,906

[45] Jan. 4, 1983

[54] MERCHANDIZING HOLDER DEVICE

[76] Inventor: Patrick H. Joyce, 28 Plymouth Ct., Lincolnshire, Ill. 60015

[21] Appl. No.: 196,392

[22] Filed: Oct. 14, 1980

[51] Int. Cl.[3] ..... A47F 5/08

[52] U.S. Cl. ..... 211/59.1; 211/104; 248/220.4; 248/290

[58] Field of Search ..... 211/54.1, 48, 57.1, 211/104, 59.1, 96, 168; 248/220.3, 220.4, 221.1, 221.2, 308, 303, 290, 294, 289.1

[56] References Cited

U.S. PATENT DOCUMENTS

| | | | |
|---|---|---|---|
| 354,903 | 12/1886 | Hastings . | |
| 741,004 | 10/1903 | Van Nostran . | |
| 1,333,600 | 3/1920 | Bell . | |
| 1,803,016 | 4/1931 | Harsted . | |
| 1,938,390 | 12/1933 | Bodkin . | |
| 2,087,141 | 7/1937 | Farrar . | |
| 2,149,978 | 3/1939 | Noel . | |
| 2,447,128 | 8/1948 | Logan . | |
| 2,499,159 | 2/1950 | Pestyner | 211/96 |
| 2,515,293 | 7/1950 | Carter | 211/89 |
| 2,603,359 | 7/1952 | Pestyner | 211/87 |
| 2,614,701 | 10/1952 | Mapson | 211/87 |
| 2,671,232 | 3/1954 | Brancel | 248/289.1 X |
| 2,797,817 | 7/1957 | Shugarmon | 211/96 |
| 3,458,946 | 8/1969 | Lasswell | 40/19.5 |
| 4,094,415 | 6/1978 | Larson | 211/57.1 |

FOREIGN PATENT DOCUMENTS

| | | | |
|---|---|---|---|
| 1226018 | 7/1960 | France | 248/211.2 |

*Primary Examiner*—Roy D. Frazier
*Assistant Examiner*—Robert W. Gibson, Jr.
*Attorney, Agent, or Firm*—Wegner, McCord, Wood & Dalton

[57] ABSTRACT

A flattenable merchandising holder device including a pair of mounting elements swingably mounted in a display panel. The mounting elements define flatted locking portions engaging cooperating mounting channels on the display panel for selectively retaining the mounting elements in an operative position wherein a support provided on the lower end thereof extends forwardly from the lower end of the display panel. In a retracted position, the support elements are swung into general alignment with the flat plane of the display panel so as to define a flat arrangement of the device. The locking action is effected by longitudinally positioning the mounting element relative to the mounting channel. A connector is provided on the mounting element for mounting of the device to a perforated wall board. The display panel is provided with channel portions for removably mounting a display card element, such as for use with the merchandise intended to be carried on the support portion.

13 Claims, 7 Drawing Figures

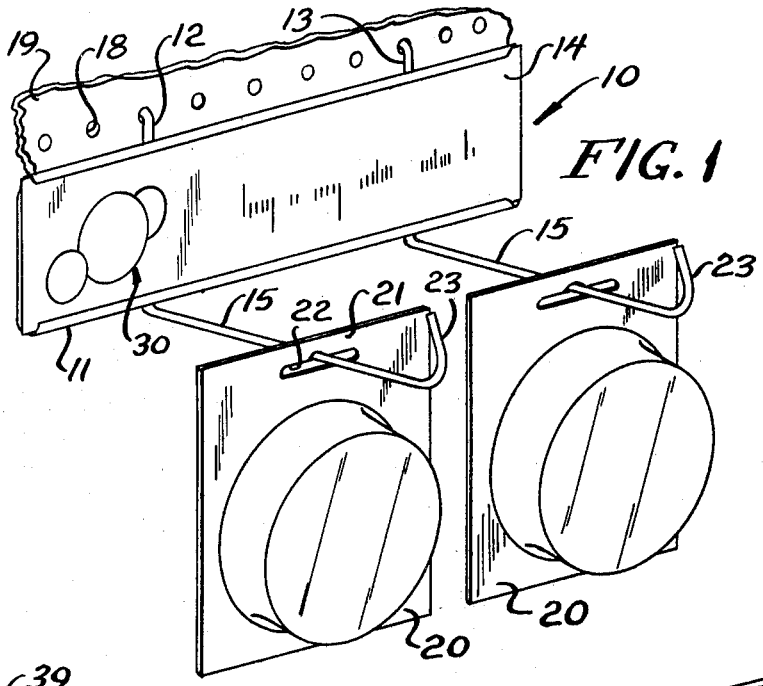
FIG. 1
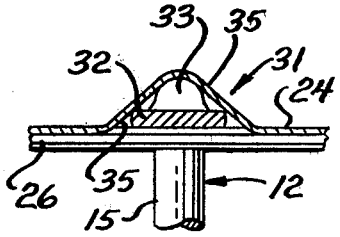
FIG. 7
FIG. 2
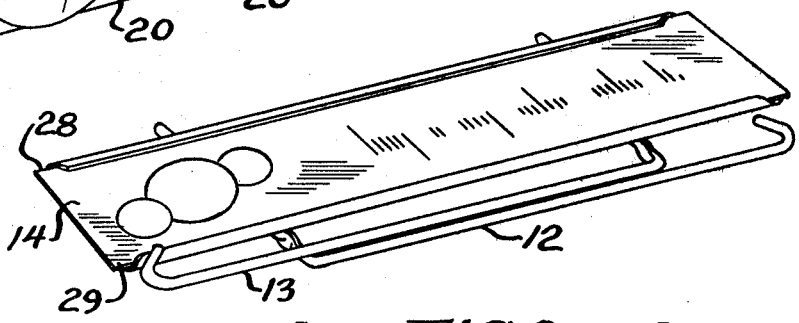
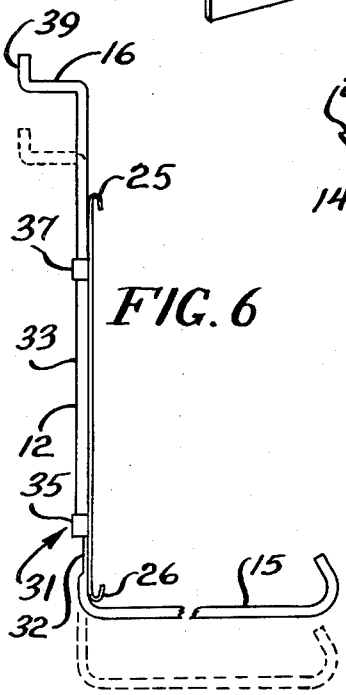
FIG. 6
FIG. 3
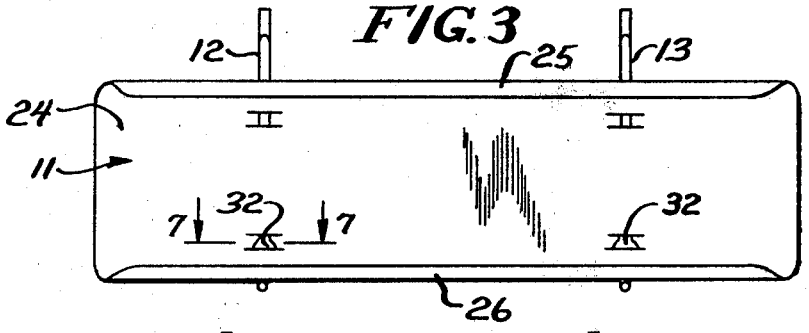
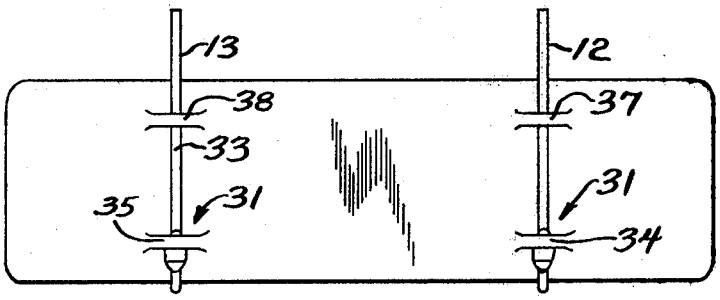
FIG. 4
FIG. 5
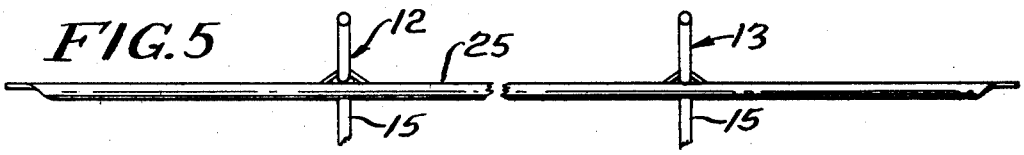

MERCHANDIZING HOLDER DEVICE

BACKGROUND OF THE INVENTION

1. Field of the Invention

This invention relates to merchandising devices and in particular to merchandising devices adapted to be selectively collapsed into a flat storage arrangement.

2. Description of the Background Art

A number of merchandising display devices have been developed for facilitated display and dispensing of packaged merchandise. Illustratively, Alfred L. Snape discloses, in U.S. Pat. No. 3,025,968, a display stand having a plurality of hook members pivotally mounted to a base panel of the stand so as to be selectively disposed in forwardly extending merchandise carrying disposition and an upwardly retracted storage disposition. The hook members include turned end portions movably received in holes in the base to provide such selected dispositioning.

Robert M. Inman, in U.S. Pat. No. 3,033,377, shows a hanger bracket for bottle cartons wherein a rod support member is provided with a turned mounting portion having a lug selectively received in a slot for rotation-limiting retention of the bracket.

In U.S. Pat. No. 4,094,415, Charles O. Larson shows a display rack device wherein merchandise supporting members are slidably received in a channel carried on a baseplate in turn mounted to a pegboard by rod support members.

In U.S. Pat. No. 4,109,795, Barry S. Konigsford et al show a display rack for supporting packaged articles, formed of a plurality of rods having turned end portions adapted to be fitted in the openings of a pegboard. The rods incorporate detents for preventing packages from slipping from the distal ends.

SUMMARY OF INVENTION

The present invention comprehends an improved folding, flattenable pegboard merchandising display device having a display panel and mounting elements movably carried by the display panel for selective disposition in an extended merchandise carrying arrangement and in a retracted, flat storage arrangement.

The mounting elements are provided with support portions for carrying the packaged merchandise and may terminate in their distal ends in a returned portion for preventing inadvertent removal of the merchandise from the support portion and to prevent accidental injury from pumping into the distal end.

Connecting means are provided on the mounting rod for connecting the mounting rod to a vertical wall, such as a vertical pegboard wall.

Means are provided on the panel defining a mounting channel cooperating with complementary means on the mounting elements for locking the mounting elements against rotation in a selected disposition of the mounting elements on the display panel.

In the illustrated embodiment, the locking means comprises flatted portions of the mounting elements received in complementary, noncylindrical channel members on the display panel.

The display panel, in the illustrated embodiment, further defines channels for removably receiving a display element, such as an advertising card.

The locking means of the present invention not only retains the support means in accurately, forwardly extending disposition for supporting the removable merchandise thereon, but concurrently locks the mounting hooks in an accurately rearwardly extending disposition for facilitated retention thereof in the holes of the pegboard mounting wall. As a result of the selective longitudinal positioning of the mounting elements to effect the desired locked and unlocked condition of the locking means, the locking action is effected by a simple positioning of the display panel relative to the mounting elements without the need for further securing means.

The merchandising device of the present invention is extremely simple and economical of construction while yet providing the highly desirable features and advantages discussed above.

BRIEF DESCRIPTION OF THE DRAWING

Other features and advantages of the invention will be apparent from the following description taken in connection with the accompanying drawing wherein:

FIG. 1 is a perspective view of a merchandising device embodying the invention shown in merchandising supporting disposition on a perforated pegboard wall panel;

FIG. 2 is a perspective view illustrating the arrangement of the merchandising device in the flat, storage disposition;

FIG. 3 is a front elevation of the storage device with the display element removed;

FIG. 4 is a rear vertical elevation thereof;

FIG. 5 is a fragmentary enlarged top plan view thereof;

FIG. 6 is a side elevation thereof with the mounting element shown further in the unlocked disposition in broken lines; and FIG. 7 is a fragmentary enlarged transverse section taken substantially along the line 7—7 illustrating in greater detail the cooperating relationship of the elements of the locking means.

DESCRIPTION OF THE PREFERRED EMBODIMENT

In the exemplary embodiment of the invention as disclosed in the drawing, a flattenable merchandising display device generally designated 10 is shown to include a display panel 11, a pair of mounting elements 12 and 13, and a display element 14 removably carried by the display panel 11.

Each of the display elements 12 and 13 further defines a turned support portion 15 at one end, and an oppositely turned connecting portion 16 at the opposite end. As shown in FIG. 1, in the installed arrangement of the device 10, the connecting portion of each of the mounting elements 12 and 13 may be received in one of the openings 18 of a perforated pegboard wall panel 19 to mount the device thereto. In the installed arrangement, the support portion 15 of each of the mounting elements extends forwardly perpendicular to the flat plane of the display panel 11 for suitably removably carrying a plurality of merchandise packages 20, which illustratively may be provided with a support card portion 21 having a suitable opening 22 permitting the merchandise to be removably slidably carried on the support portion. As illustrated in FIG. 1, the distal end 23 of the support portion may be turned to define means for preventing inadvertent removal of the merchandise from the support portion.

As shown in FIG. 1, in the installed arrangement of the device, the support portions 15 of the mounting elements 12 and 13 extend forwardly parallel to each other so that two sets of the merchandise 20 may be carried in side-by-side relationship thereon. As will be obvious to those skilled in the art, additional such mounting elements may be provided for carrying additional merchandise in further side-by-side relationship, the display panel 11 being suitably elongated to accommodate the desired number of such elements.

The display panel includes a flat base portion 24, a turned upper edge portion 25, and a turned lower edge portion 26, the edge portions 25 and 26 effectively defining confronting slide channels adapted to receive the edges 28 and 29 of the display element 14 for slidably receiving and retaining the display element on the front face of the display panel 11. The display element may be provided with suitable indicia, generally designated 30, such as advertising or identification indicia corresponding to the merchandise 20 intended to be carried on the device.

As indicated above, the invention comprehends improved means for selectively retaining the mounting elements 12 and 13 in the extended disposition of FIG. 1, while yet permitting the ready arrangement of the device in the flat storage position of FIG. 2, when desired. Thus, the device may be provided to the user in the flat form, permitting a number of such devices to be stored in a small package. The invention comprehends the provision of simple, effective locking means 31 for locking the mounting elements in the extended arrangement when desired. More specifically, as best seen in FIGS. 4, 6 and 7, the locking means comprises a widened, flatted portion 32 of the upright midportion 33 of the mounting elements 12 and 13. Display panel base 24 is provided with a pair of rearwardly struck tabs 34 and 35, respectively, with the midportion 33 of each of the mounting elements extending upwardly through the channel 36 defined by the tabs. As shown, midportion 33 of the mounting element is cylindrical and, thus, is free to turn in the channel 36 when the flatted portion 32 thereof is disposed below the tab, as shown in full lines in FIG. 6. Resultingly, the mounting element may be swung about the longitudinal axis of midportion 33, such as to the folded arrangement of FIG. 2, or to the extended arrangement of FIG. 6, as desired.

To lock the mounting elements in the forwardly extending mounting disposition of FIG. 6, the user simply moves the mounting element midportion 33 upwardly to engage the flatted locking portion 32 thereof with the tab in the channel 36, as illustrated in FIGS. 3 and 7. As the flatted portion 32 is noncircular, the mounting element is thusly prevented from rotating about the longitudinal axis of portion 33, effectively locking the device in the assembled arrangement of FIG. 1.

A second pair of tabs 37 and 38 may be provided struck from the display panel base 24 above the tabs 34 and 35, respectively, to maintain the mounting element midportions 33 in vertical spaced relationship on the rear face of the display panel.

As further illustrated in FIGS. 5 and 6, the connecting portion 16 of each of the mounting elements extends from the upper end of the midportion 33 thereof and is provided with an upturned distal end portion 39 for locking the connecting portions 16 to the pegboard panel 19. As is obvious to those skilled in the art, the connecting portion 16 is installed on the pegboard by inserting the end portion 39 firstly through the opening 18 with the portion 39 extending perpendicular to the front surface of the pegboard panel 19, and upon the portion 39 being received rearwardly of the panel, permitting the device to be swung down to the position of FIG. 1, with the end portion 39 bearing against the rear of panel 19 to retain the device in mounted disposition thereon.

As indicated above, the locking means 31 effectively retains the support portion 15 of the mounting elements in forwardly extending disposition while concurrently retaining the connecting portion 16 in rearwardly extending disposition for facilitated installation and removal of the display device relative to the wall panel in accurate maintained disposition of the support portions 15 in parallel spaced relationship to support the merchandise 20 in side-by-side relationship thereon, as illustrated in FIG. 1. The locking of the display device in the operative disposition of FIG. 1 is effected by means of the improved structure of the present invention by the simple movement of the display panel relative to the mounting elements to bring the locking portions 32 into the channels 36, as discussed above. The weight of the display panel effectively maintains the tabs in locked association with the flatted locking portions 32 in the assembled arrangement of FIG. 1.

By preventing pivotal movement of the mounting elements in the installed arrangement of the device, wear on the openings 18 in which the connecting portions 16 are received is effectively minimized to provide further improved mounting of the device on the pegboard wall panel 19.

The structure of the display device 10 is extremely simple and economical with the display panel being preferably formed of suitably formed sheet metal and the mounting elements being suitably formed of metal rod material.

The foregoing disclosure of specific embodiments is illustrative of the broad inventive concepts comprehended by the invention.

I claim:

1. A flattenable merchandising device comprising:

a display panel;

a mounting element having a cylindrical portion and a noncylindrical portion;

support means on said mounting element for supporting a plurality of articles to be merchandised forwardly of said panel;

connecting means on said mounting element for connecting the mounting element to a vertical wall; and means on said panel defining a mounting channel complementary in section to said noncylindrical portion of the mounting element and receiving said mounting element for axial movement therein between a first position wherein said cylindrical portion is pivotally disposed in the channel and a second position wherein the noncylindrical portion is held against pivotal movement in the channel, with said support means and connecting means extending outwardly from said panel, said support means and connecting means being swingable to be substantially flat with said panel in a retracted disposition when said mounting element is in said first position.

2. The merchandising device of claim 1 wherein said mounting element comprises a rod.

3. The merchandising device of claim 1 wherein said mounting element comprises a rod and said support means comprises an integral extension of said rod.

4. The merchandising device of claim 1 wherein said mounting element comprises a rod and said connecting means comprises an integral extension of said rod.

5. The merchandising device of claim 1 wherein said mounting element comprises a rod and said noncylindrical portion comprises a flatted portion of the rod.

6. The merchandising device of claim 1 wherein said support means and connecting means extend in opposite directions outwardly from the panel.

7. The merchandising device of claim 1 wherein said mounting element defines a second cylindrical portion and means are provided on said panel defining a second mounting channel movably receiving said second cylindrical portion.

8. A flattenable merchandising device comprising:

a display panel;

a mounting rod having a cylindrical portion and a noncylindrical portion;

support means on one end of said mounting rod for supporting a plurality of articles to be merchandised forwardly of said panel;

connecting means on the opposite end of said mounting rod for connecting the mounting rod to a vertical wall;

means on said panel defining a mounting channel complementary in section to said noncylindrical portion of the mounting rod and receiving said mounting rod for axial movement therein between a first position wherein said cylindrical portion is pivotally disposed in the channel and a second position wherein the noncylindrical portion is held against pivotal movement in the channel, with said support means and connecting means extending outwardly from said panel, said support means and connecting means being swingable to be substantially flat with said panel in a retracted disposition when said mounting rod is in said first position; and a display element removably carried by said display panel receivable above said support means when said support means is arranged to extend outwardly from said display panel.

9. The merchandising device of claim 8 wherein said display panel defines retaining flanges and said display element defines edges retained to the display panel by said flanges.

10. The merchandising device of claim 8 wherein said display panel defines a lower edge and said support means extends outwardly from adjacent said lower edge.

11. The merchandising device of claim 8 wherein said display panel defines a lower edge and an upper edge, said support means extends outwardly from adjacent said lower edge, and said connecting means extends outwardly from adjacent said upper edge.

12. The merchandising device of claim 8 wherein said connecting means comprises an L-shaped end portion of said rod adapted to be received in an aperture of a pegboard wall panel for supporting the device on the wall panel.

13. The merchandising device of claim 8 wherein said mounting channel means comprises a formed portion of said display panel.

* * * * *